US008998073B2

(12) United States Patent
De Beer

(10) Patent No.: US 8,998,073 B2
(45) Date of Patent: Apr. 7, 2015

(54) STACKABLE OPEN TOPPED BOX WITH INDENTED SIDE EDGES

(71) Applicant: Stephanus Petrus De Beer, Cape Town (ZA)

(72) Inventor: Stephanus Petrus De Beer, Cape Town (ZA)

( * ) Notice: Subject to any disclaimer, the term of this patent is extended or adjusted under 35 U.S.C. 154(b) by 0 days.

(21) Appl. No.: 14/359,085

(22) PCT Filed: Nov. 15, 2012

(86) PCT No.: PCT/IB2012/056453

§ 371 (c)(1),
(2) Date: May 16, 2014

(87) PCT Pub. No.: WO2013/072869

PCT Pub. Date: May 23, 2013

(65) Prior Publication Data

US 2014/0326782 A1 Nov. 6, 2014

(30) Foreign Application Priority Data

| | | |
|---|---|---|
| Nov. 18, 2011 | (ZA) | 2011/08463 |
| Dec. 5, 2011 | (ZA) | 2011/08899 |
| Jul. 23, 2012 | (ZA) | 2012/05515 |

(51) Int. Cl.

| | |
|---|---|
| ***B65D 5/20*** | (2006.01) |
| ***B65D 5/00*** | (2006.01) |
| ***B65D 5/42*** | (2006.01) |
| *B65D 21/032* | (2006.01) |

(52) U.S. Cl.

CPC ..... *B65D 5/0045* (2013.01); *B65D 5/002* (2013.01); *B65D 5/001* (2013.01); *B65D 5/4204* (2013.01); *B65D 5/4295* (2013.01); *Y10S 229/918* (2013.01); *Y10S 229/919* (2013.01)

(58) Field of Classification Search

USPC ..... 229/164, 178, 191, 915, 918, 919

See application file for complete search history.

(56) References Cited

U.S. PATENT DOCUMENTS

| | | | | | |
|---|---|---|---|---|---|
| 2,744,675 | A * | 5/1956 | Crane | 229/915 |
| 2,910,220 | A * | 10/1959 | Hamilton | 229/178 |
| 2,965,279 | A * | 12/1960 | Campbell | 229/178 |
| 3,036,753 | A * | 5/1962 | Davis et al. | 229/915 |
| 3,268,147 | A * | 8/1966 | Burger | 229/191 |
| 4,799,620 | A * | 1/1989 | Vilella | 229/191 |
| 4,844,331 | A * | 7/1989 | Oldfather | 229/178 |
| 5,052,615 | A * | 10/1991 | Ott et al. | 229/178 |
| 6,481,619 | B1 * | 11/2002 | Jackson | 229/918 |
| 6,513,705 | B1 * | 2/2003 | Sheffer | 229/178 |
| 2006/0124710 | A1 * | 6/2006 | Sun | 229/164 |
| 2006/0231603 | A1 | 10/2006 | McLeod | |

FOREIGN PATENT DOCUMENTS

DE 1486263 A1 1/1969

* cited by examiner

*Primary Examiner* — Gary Elkins

(74) *Attorney, Agent, or Firm* — McDermott Will & Emery LLP

(57) ABSTRACT

A stackable open topped box and a blank from which it is folded are provided in which a fluted sheet material is cut and sulcated to form a box The flutes extend parallel to the side walls of the box and up the height of the end walls. Each side wall has an indent whereof the ends terminate in a diagonal fold inclined upwardly and towards the adjacent end of the box at an angle of 45°. The fluted sheet material originally adjacent the edge of the indent is folded inwards and downwards as a composite flap such that the flutes of the fluted material are generally vertical and the material extends to substantially the bottom of the box. A strip that is approximately beneath the diagonal fold is flush with the inside of the side wall of the box.

14 Claims, 7 Drawing Sheets

STACKABLE OPEN TOPPED BOX WITH INDENTED SIDE EDGES

FIELD OF THE INVENTION

This invention relates to a stackable open topped box made of folded fluted sheet material selected from corrugated cardboard and extruded fluted plastic sheet material. More particularly, the invention relates to an open topped box that has a central elongate indentation in the upper edge of each sidewall that serves as an inspection and ventilation opening between vertically stacked boxes. Still more particularly, the invention relates to a stackable open topped box that has pillar formations in the corners whereby at least a substantial portion of the weight of boxes stacked on top of each other is carried.

The invention also relates to a blank cut and sulcated sheet of fluted material from which such a box may be erected.

In this specification the words sulcated, sulcation or sulcate each relates to a fold line or the formation of a fold line that is typically a groove, or a groove arrangement of two or more closely spaced parallel grooves; one or more spaced cuts through the sheet material; a combination of one or more spaced cuts and an in-line groove or groove arrangement; or any other line of weakening along which the sheet material will fold in preference to other areas of the sheet of material that are not sulcated. A sulcation may thus take many different forms depending on the thickness of the fluted sheet material in amongst other factors.

In this specification the terms end wall and side wall will be used to distinguish one type of wall from another and must not be interpreted as meaning that any one type of wall is necessarily longer than the other.

In this specification a dominant part of the description will relate to corrugated cardboard as such a material is currently almost exclusively used for the subject purpose. However, it will be understood by those of ordinary skill in the art that exactly the same principles can be applied to any other fluted sheet material such as extruded fluted plastic sheet material and such other fluted sheets are intended to fall within the scope hereof with possible consequential differences as regards the manner in which sulcations are formed that may involve heat softening the material and then forming fold lines.

BACKGROUND TO THE INVENTION

Open topped corrugated cardboard boxes are widely used for the transport, storage and display of fresh produce, especially fresh fruit and vegetables. Such produce is relatively heavy and the boxes need to be capable of being stacked one on top of the other to at least a reasonable height and may entail stacking of from 5 to 10 boxes on top of a lowermost box.

The size of the boxes is targeted at containing a predetermined weight of a predetermined type of fresh produce and may be dictated, at least to some extent, by the size of a pallet on which the boxes are to be transported. Also, as regards their height, the height of a container or other transport vehicle in which they are to be transported will be relevant as well as the general physical size and nature of the type of fresh produce. Many different sizes of boxes are thus manufactured, typically for specific purposes and generally for holding a quantity of a specific type of fruit or vegetable. In any event the objective is to occupy substantially all of the area of a pallet and substantially all of the height of a container or transport vehicle body. Just by way of example, one typical size of a so called citrus box is 594 mm long by 390 mm wide and 169 mm high; one typical size of a so called grape box is 392 mm long by 295 mm wide and 120 mm high; and one typical size of a so called avocado pear box is 360 mm long by 275 mm wide and 90 mm high. Numerous other sizes will be appropriate for other purposes.

Irrespective of the exact size of a box, it is important that the configuration of folds made in a pre-cut and sulcated blank in order to erect a box does not result in any unused space between adjacent boxes. External flaps secured to the outer surfaces of the sides or ends of a box are therefore generally avoided in favour of flaps secured internally to the surfaces of the walls. Also, in order to provide for ventilation and at least a limited amount of inspection of the contents of a box, a major part of the length of the upper edges of the side walls have part of the height, typically about 25 mm, cut away to provide indentations that form openings in vertical stacks of boxes.

Supporting pillars at the corners of a box are created by folding the pre-cut and sulcated sheet material to form what are generally, but not necessarily, triangular pillars. Of course, the strength of a pillar is very much enhanced if the length of the flutes or corrugations extends up the height of the box.

Various different configurations of cuts and folds have been used in the past with different degrees of efficacy and economy of sheet material that is consumed in producing the blanks. The strength of the pillar will, of course, depend on the strength of the sheet material as well as on the cut and direction in which the flutes of various flaps extend.

The cost of a box is therefore very much dependent on the cut and fold configuration of the box, the cost of the sheet material used, and the overall size of the outer periphery of the blank before it is folded.

It is to be mentioned that blanks that are adapted to be manually folded are generally different in that they also have locking tabs and receiving apertures to lock the box in the erected condition. This often leads to extra material being used in order to provide flaps that can be manually locked in position in this manner. Blanks adapted to be manually folded are typically more expensive.

On the other hand blanks that are adapted to be machine folded are generally simply glued in their erected condition. As a general rule the machine folded boxes are preferred if a machine folding facility is available suitably close to the site where the boxes are to be filled as they are generally appreciably less costly. Obviously it is uneconomical from a transport and storage point of view to transport or store any appreciable numbers of erected boxes so that it is usual to transport and store the blanks pending erection for use.

In order to facilitate stacking and vertical alignment of stacked boxes, it is commonplace to provide cut-outs in the lower edge of each of the end walls that register with upstanding tabs forming extensions of the upper edges of the end walls of the next lower box on which a box is being stacked. It is, accordingly, important that the tabs are properly aligned with the cut-outs in the stacked condition and it is not always easy to align such boxes in the event that the upper edges of the end walls are simply cut or folded over edges that are not much more than the thickness of the fluted sheet material being used.

In order to facilitate stacking, the end walls have, in many instances, been provided with an inwardly directed horizontal section termed a ledge so that the bottom of a box can be slid a short distance on the ledges to cause proper registration of the tabs and cut-outs. The ledges typically cover the upper ends of the pillar formations.

In one currently available type of box that has ledges of this nature, the ends of the ledge are extended to provide a side wall attachment flap to be adhesively secured to the inside of the side wall when the box is erected and a second end wall attachment flap secured to the side wall attachment flap by way of a fold. The side walls of the box have attached thereto by way of a fold a first end wall attachment flap the other edge of which has attached thereto, by way of a fold, a pillar forming diagonal flap. This arrangement neatly utilises an exactly rectangular area for the blank with the flutes or corrugations extending longitudinally so that the flutes in the ends of the box extend vertically.

The problem with this arrangement is that the flutes of all of the side wall attachment flap, the second end wall attachment flap (both of which are attached to the ledge), the first end wall attachment flap and pillar forming diagonal flap that are attached to the side wall have the flutes extending horizontally; that is in the weaker of the two directions, at the pillar. This is a natural consequence of the design of the blank of the box and leads to a heavier grade of corrugated cardboard being needed than would otherwise be the case.

It has now surprisingly been found that by reorganising the attachment flaps and ledge it is possible that all of the attachment flaps and any pillar forming diagonal flap can have the flutes extending vertically in the erected condition with consequent enhancement of strength and a potential reduction of cost and strength required of the corrugated cardboard.

SUMMARY OF THE INVENTION

In accordance with one aspect of this invention there is provided a stackable open topped box made of a folded blank of fluted sheet material in which two opposite side walls and two opposite end walls are folded at generally right angles along sulcations attaching them to a rectangular bottom of the box wherein the flutes extend parallel to the side walls of the box and up the height of the end walls, wherein the side walls have an indent extending along the upper edge thereof for a substantial part of the length of the side wall with each end of the indent terminating in a diagonal fold inclined upwardly and towards the adjacent end of the box at an angle of 45° with fluted sheet material originally adjacent the edge of the indent being folded inwards and downwards as a composite flap such that the flutes of the fluted material are generally vertical and the material extends to substantially the bottom of the box and whereof a strip that is approximately beneath the diagonal fold is flush with the inside of the side wall of the box.

The strip of the composite flap is preferably adhesively secured to the inside surface of the side wall of the box.

Further features of the invention provide for the composite flap to include a first and optionally a second auxiliary pillar flap attached to the strip on the side thereof nearer the adjacent corner with the one or two auxiliary pillar flaps being attached to the strip and to each other by generally vertical fold lines at sulcations extending up the height of the box; for the side walls to have a small ledge panel attached to an upper edge of the relevant side wall adjacent the upper end of the diagonal fold by way of a fold at a sulcation so as to project over a pillar formation in a corner of the box, with the ledge panel being preferably of a triangular shape in cross-section; for the pillar formation to include a first pillar flap having an upper end connected to an end of the ledge panel by way of a fold at a sulcation with the first pillar flap extending substantially to the bottom of the box and being secured to the adjacent end wall thereby conforming to a corner of the box, and at least second and third pillar flaps attached to the first pillar flap and each other by folds at sulcations extending up the height of the box with the second pillar flap being secured to the side wall, or an attachment flap that may already be secured to the side wall and being attached to the first pillar flap substantially in the corner of the box, wherein the arrangement is such that the flutes of each of any attachment flap, and the first, second and third pillar flaps, as well as the composite flap, extend in the direction of the height of the box.

Still further features of this aspect of the invention provide for the first pillar flap to have a coplanar extension extending away from the corner of the box and being secured to the inside of the end wall; for a fourth pillar flap to be attached to the third pillar flap by a fold at a sulcation with the flutes of the fourth pillar flap also extending up the height of the box; for the third pillar flap to either extend diagonally across the corner to form a triangular cross-sectioned pillar in which instance any fourth pillar flap may be secured to the inside of the end wall or the inside of the first pillar flap or a coplanar extension thereto, or alternatively, for the third pillar flap to be secured back onto the second pillar flap in which instance any fourth pillar flap may be secured to the inside of the first pillar flap that is secured to the end wall; and for the end walls of the box to have upwardly projecting tabs at the upper edges thereof and corresponding cut-outs in the lower edges thereof in order to facilitate vertical alignment of boxes when stacking one box on top of another.

As regards the end walls that have the flutes extending up the height thereof, a single attachment flap may optionally be provided at each end of the wall with the attachment flap being defined by a sulcation of the sheet material extending up the height of the box. In such an instance each attachment flap extends at generally right angles to the end wall to which it is attached and is secured to the adjacent end wall or side wall to thereby conform to a corner of the box.

However, such an attachment flap is not always necessary or required and each end wall could be simply cut straight and adhesively secured to the formed pillar formation.

In accordance with a second aspect of the invention there is provided a blank of fluted sheet material that has been cut and sulcated to be folded into a box as defined above, the blank being basically in the form of a rectangular piece of fluted sheet material cut and sulcated to provide two opposite side walls and two opposite end walls attached along sulcations to a rectangular bottom of the box wherein the flutes extend along the length of the side walls and in a direction corresponding to the height of the end walls; and wherein the side walls have an indent extending along the edge thereof remote from the bottom for a substantial part of the length of the side wall with each end of each indent terminating in a diagonal sulcation inclined outwards in a direction corresponding to the adjacent end of the box at an angle of 45° with fluted sheet material adjacent the edge of the indent forming a composite flap capable of being folded along the diagonal sulcation over the sidewall such that the flutes of the composite flap extend at right angles to those of the side wall, wherein the composite flaps are dimensioned such that, in such folded over position, the composite flaps extend to substantially the bottom of the box.

Further features of this aspect of the invention provide for the side walls to have a small ledge panel attached to the outermost edge towards each end of the relevant side wall by way of a sulcation, and wherein the ledge panel is attached by way of a sulcation to one end of a first pillar flap extending in the direction of the flutes and that is, in turn, attached to at least a second and a third pillar flap each of which is attached to the other by a sulcation extending in a direction corresponding to the height of the box and the direction of the flutes, the arrangement being such that the flutes of each of the first, second and third pillar flaps extend in a direction corresponding to the height of the box in the erected condition of the blank.

Still further features of this second aspect of the invention provide for the first pillar flap to have a coplanar extension on the side thereof opposite the second pillar flap; for a fourth pillar flap to be attached to the third pillar flap by a sulcation with the flutes of the fourth pillar flap also extending in a direction corresponding to the height of a box; for each of the end walls to have an attachment flap at each of its ends defined by a corner-defining sulcation of the sheet material at each end of the end wall where in the flutes of each attachment flap extending a direction corresponding to the height of the box; and for the second and third pillar flaps to be positioned between the first pillar flap and the adjacent attachment flap in the erected condition of the box.

It will be understood that with the above arrangement each composite flap is separated from the adjacent indented edge of a sidewall and from the corresponding edge of the adjacent composite flap by a cut and possibly a gap depending on the thickness and configuration of the fluted sheet material and the dimensions of the box itself. Also, each attachment flap in the preferred form of the invention, lies next to, with the flutes extending parallel to, those of the fourth (where it is present), third, second, and first pillar flaps in that order whilst being separated from the nearest pillar flap by a cut and possibly a small gap depending on the thickness of the fluted sheet material with the ends of the attachment, fourth, third, and second flaps all being separated from the side wall to which the ledge panel is attached.

It is an important feature of the invention is that the blanks are especially designed so as to be capable of machine erection utilising adhesive to secure appropriate areas of the fluted sheet material together.

In order that the invention may be more fully understood, various different embodiments thereof will now be described with reference to the accompanying drawings.

DETAILED DESCRIPTION WITH REFERENCE TO THE DRAWINGS

Figure 1:
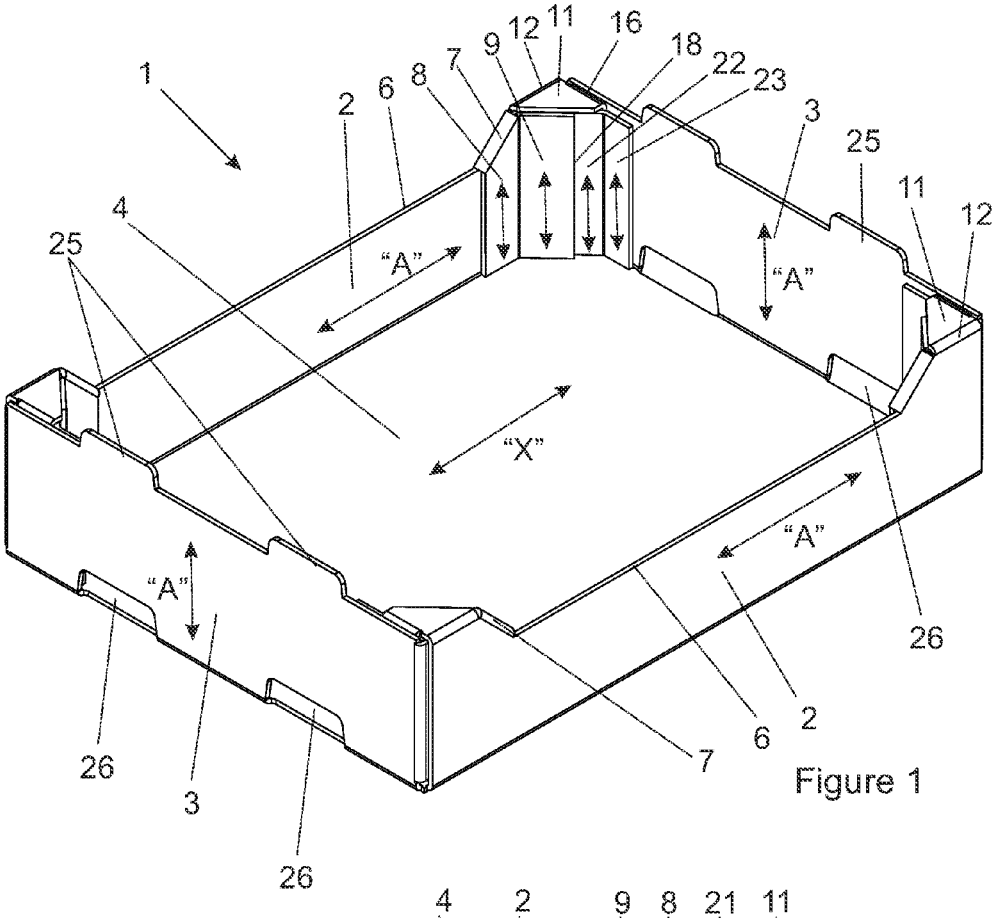
FIG. 1 is an isometric view of an erected box folded from a blank illustrated in FIG. 4.
Figure 2:
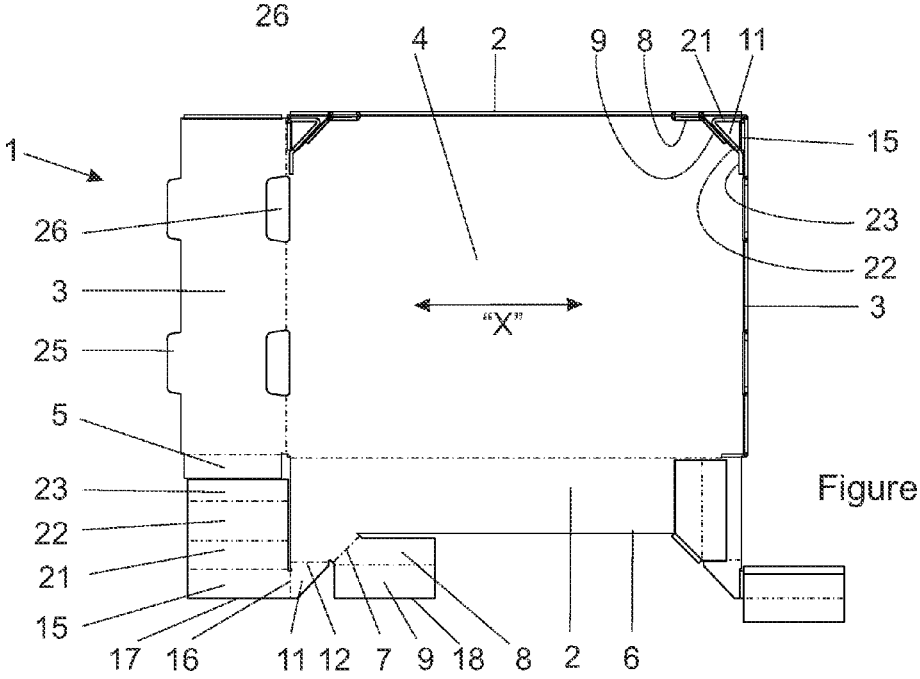
FIG. 2 is a plan view of a partially erected box as illustrated in FIG. 1 and showing one incompletely folded side and one with completed pillar formations.
Figure 3:
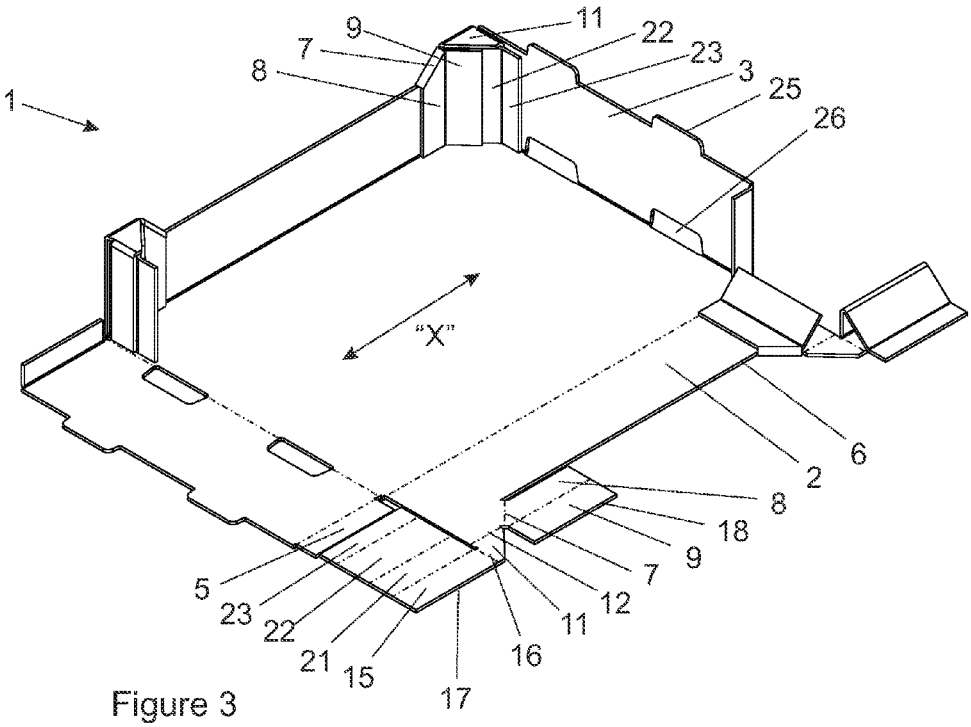
FIG. 3 is an isometric view of the partially folded box illustrated in FIG. 2.

In the embodiment of the invention that is illustrated in FIGS. 1 to 4 of the drawings, a stackable open topped box (1) is made of a folded cut and sulcated blank of fluted sheet material, in this instance a corrugated cardboard material that for heavy duty purposes may have two (or even more) layers of fluting in the form of corrugations that may be somewhat different in configuration but do extend in the same direction. The general nature of such a corrugated cardboard sheet material is discussed somewhat further below.

The box has two opposite side walls (2) and two opposite end walls (3) that are folded at generally right angles along sulcations attaching them to a bottom (4). As required by this invention the flutes of the corrugated cardboard material extend in a direction that is parallel to the side walls of the box and therefore up the height of the end walls of the box. In this instance, as a consequence, the side walls have the flutes of the corrugated cardboard extending generally horizontally along the length of side wall. The direction of the flutes is indicated by arrows "X" in the drawings.

The end walls each have an attachment flap (5) at each end of the wall defined by a sulcation of the sheet material extending up the height of the box. Each attachment flap extends at generally right angles to the end wall to which it is attached and is adhesively secured to the inside surface of the adjacent side wall of the box to thereby start forming a corner of the box. The flutes therefore extend up the height of the attachment flap.

The side walls each have an indent (6) extending along a major part of the length of the upper edge thereof with each end of the indent terminating in a diagonal fold (7) inclined upwardly and towards the adjacent end of the box at an angle of 45°. The fluted sheet material that was originally adjacent the edge of the indent is folded inwards and downwards about the diagonal fold as a composite flap such that the flutes of the fluted material are generally vertical and the composite flap extends to substantially the bottom of the box. A strip (8) of the composite flap that is approximately beneath the diagonal fold is adhesively secured to the inside of the side wall of the box.

In this embodiment of the invention the composite flap also includes a first auxiliary pillar flap (9) attached to the strip (8) along the edge thereof nearer the adjacent corner of the box with the attachment being by way of a fold extending along a sulcation that is generally vertical.

Attached to the remaining length of the full height of the side walls is a small triangular ledge panel (11), the attachment being by way of a fold at a sulcation (12) starting adjacent the upper end of the diagonal fold and extending to the end of the side wall. The arrangement is such that the triangular ledge panel projects over a pillar formation in a corner of the box that will be more fully described below.

The pillar formation includes a first pillar flap (15) having an upper end connected to an end of the ledge panel by way of a fold at a sulcation (16) with the first pillar flap extending substantially to the bottom of the box and being secured to the inside surface of the adjacent end wall thereby conforming to the relevant corner of the box.

In this embodiment of the invention the free edge (17) of the first pillar flap is in line with the free edge (18) of the first auxiliary pillar flap (9) forming part of the composite flap mentioned above. In this instance, second (21), third (22) and forth (23) pillar flaps are attached to the first pillar flap, and to each other sequentially, by folds at sulcations extending up the height of the box. The second pillar flap is secured to the inside surface of the side wall, or to the inside surface of the attachment flap that may already be secured to the side wall. The fold joining the first pillar flap and the second pillar flap is thus substantially in the corner of the box.

The third pillar flap (22) in this instance extends diagonally across the corner to form a triangular cross-sectioned pillar and the fourth pillar flap (23) is secured to the inside of the end wall.

Reverting now to the first auxiliary pillar flap (9) that is attached to the strip (8) and that together with it forms the composite flap, the first auxiliary pillar flap is adhesively secured to the exposed surface of the third pillar flap that defines the diagonal of the triangular cross-sectioned pillar. This has the effect of strengthening the entire construction and possibly enabling lighter weight cardboard to be employed for the production of the box and blank. The entire arrangement is such that the flutes of each of the composite flap, attachment flap, and the first, second, third and fourth pillar flaps extend in the direction of the height of the box.

As is usual in the practice of the relevant art, the end walls of the box have upwardly projecting tabs (25) at the upper edges thereof and corresponding cut-outs (26) in the lower edges thereof in order to facilitate vertical alignment of the boxes when stacking one box on top of another.

It is to be noted that the blank from which the box described above is folded is as illustrated in FIG. 4 and the folding is preferably done by machine. The detail of the cuts and sulcations will be quite apparent to those of ordinary skill in the art and need not be further described herein. Suffice it to say that, as required, any necessary small strips of material may be removed, depending on the thickness of the fluted sheet material and the overall dimensions of the box being produced in order to facilitate folding without distortion of the fluted material.

Apart from that, the blank used to produce the box described above can be cut from a rectangular sheet of material with little wastage and only cut-out areas such as between the lower edges of the composite flaps and the upper edges of the side walls for the purpose of creating the triangular ledge panels would give rise to off-cuts that need disposal as well as cut out areas of the end walls.

It will be understood by those of ordinary skill in the art that the overall dimensions of the box, and its targeted weight capacity, will dictate, to a large extent, the selection of a suitable fluted sheet material and the arrangement of pillars and flaps from which they are formed, as well as the various flaps into which the composite flap can be formed. The construction described above would be suitable, for example, for a box having the dimensions 400 mm long by 300 mm wide by 90 mm high.

Figure 6:
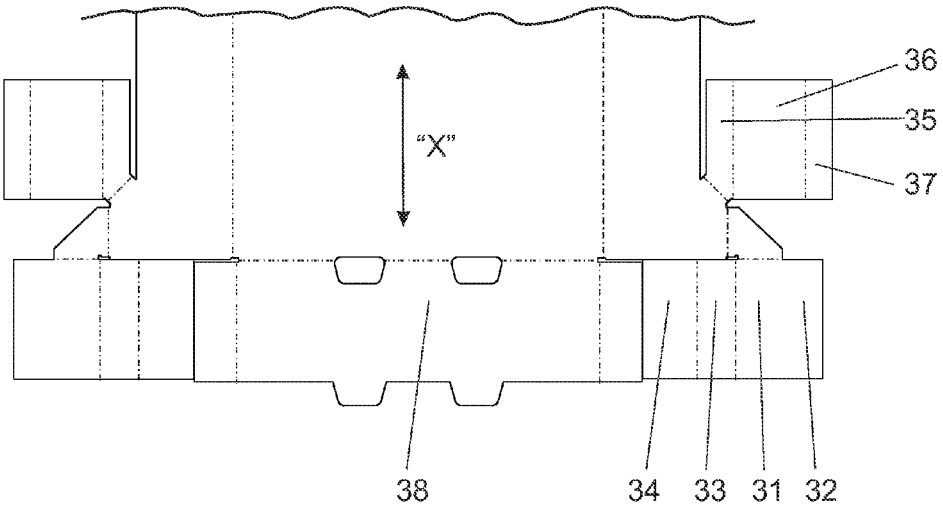
FIG. 6 is a plan view of approximately one half of the length of a blank that has been cut and sulcated to form the embodiment of box illustrated in FIG. 5.
Figure 4:
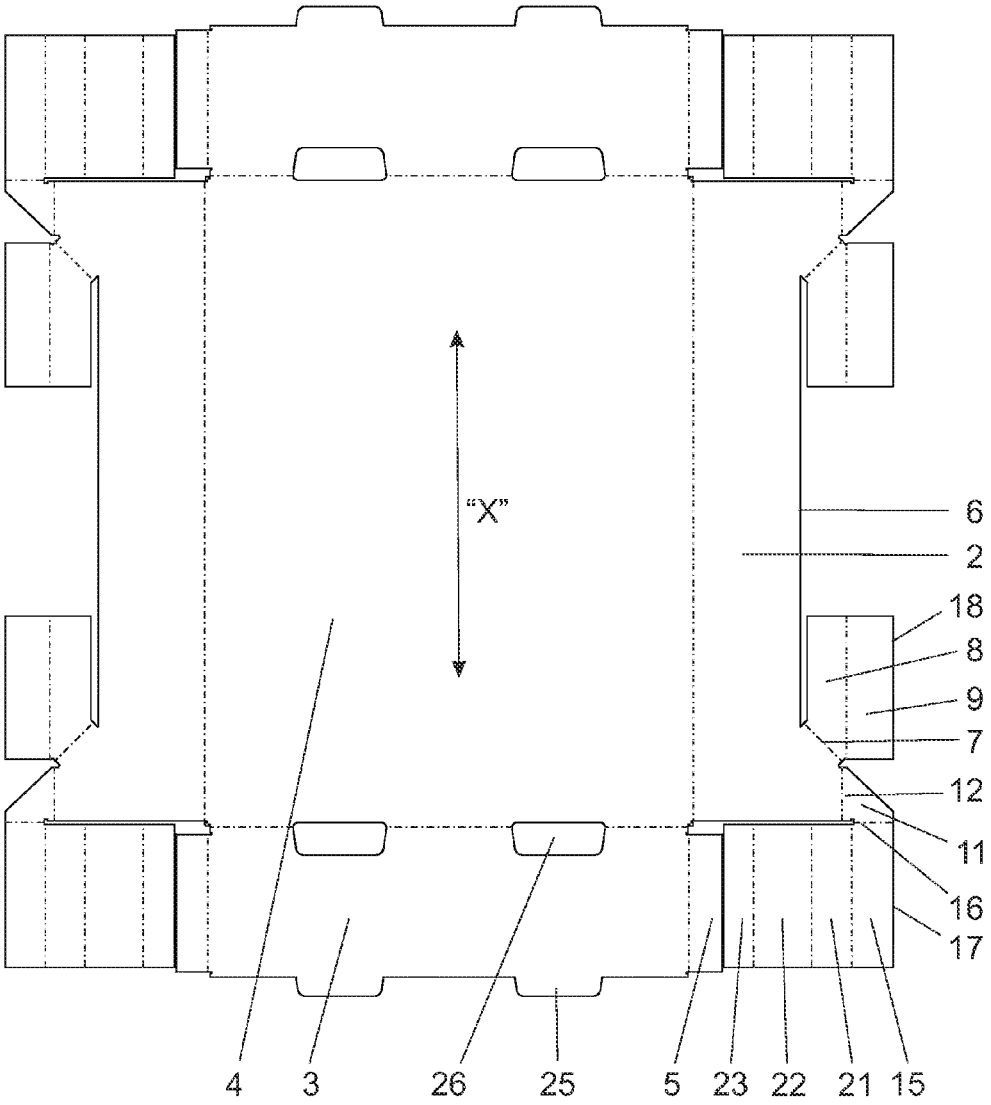
FIG. 4 is a plan view of a blank that has been cut and sulcated to be folded to form the embodiment of box illustrated in FIGS. 1 to 3.
Figure 5:
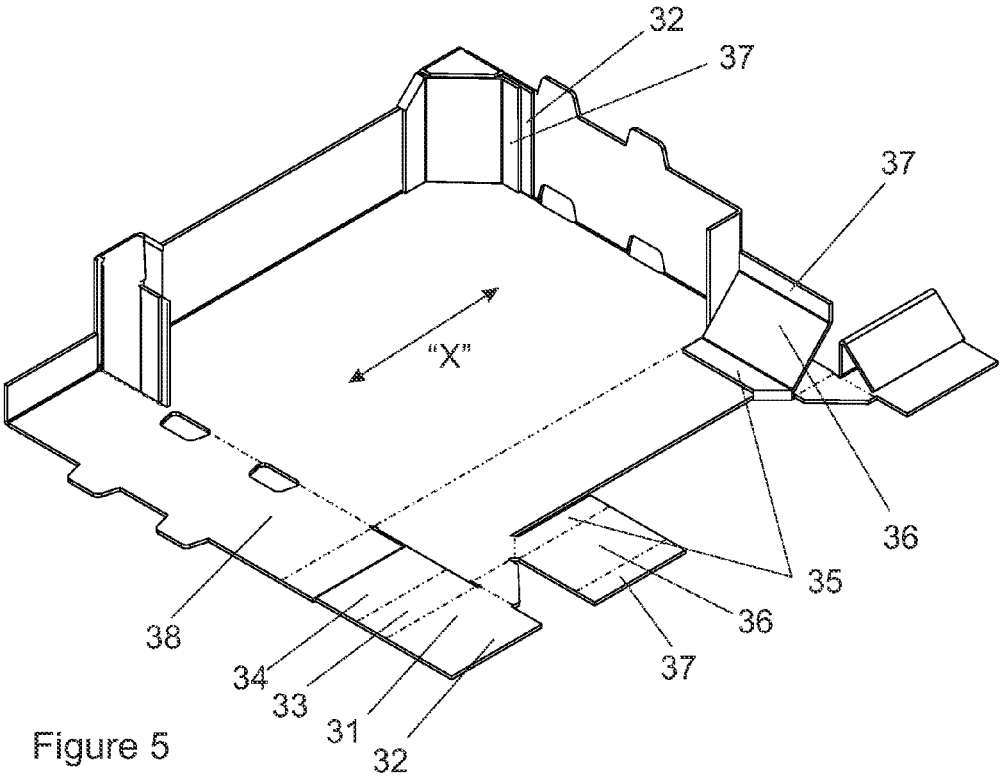
FIG. 5 is a view similar to FIG. 3 but illustrating one variation of the embodiment of the invention illustrated in FIGS. 1 to 4.

Clearly numerous variations can be made to the embodiment of the invention described above. Referring now to FIGS. 5 and 6 of the drawings, a variation is shown in which the box is particularly suitable for use in packaging avocado pears.

The box has dimensions of 360 mm long by 275 mm wide and 90 mm high. In this instance, the blank may be somewhat wider which enables the first pillar flap (31) to have a co-planar extension (32) in the direction away from the second and third pillar flaps (33, 34 respectively). However, there is no fourth pillar flap.

The added overall width of the blank enables the composite flaps to be formed into a strip (35) for adhesive securing it to the inside of the relevant side wall, and first as well as second auxiliary pillar flaps (36, 37 respectively). In this instance the first auxiliary pillar flap (36) is dimensioned so that it can be secured over the diagonally extending third pillar flap (34) that, because it has no fourth pillar flap, is simply held captive by the first auxiliary pillar flap (36). The latter is kept in position by the second auxiliary pillar flap being adhesively secured to the inside of the extension of the first pillar flap that in turn is secured to the end wall (38).

A second variation of the box described above is illustrated in FIGS. 7 and 8 of the drawings. Such a variation is considered to be particularly suitable for use in packaging grapes and has dimensions of 392 mm long by 295 mm wide and 120 mm high. In this instance, the blank may again be somewhat wider which enables the first pillar flap (41) to have a co-planar extension (42) in the direction away from the second and third pillar flaps (43, 44 respectively) and, in this instance, there is sufficient material available for a fourth pillar flap (45). The added overall width of the blank again enables the composite flaps to be formed into a strip (46) for adhesive securing to the inside of the relevant side wall and first and second auxiliary pillar flaps (47, 48 respectively). In this instance the first auxiliary pillar flap (47) is dimensioned so that it can be secured over the diagonally extending third pillar flap (44) that, in this instance, is held in its erected position by the fourth pillar flap (45) that is adhesively secured to the inside of the extension to the first pillar flap and to the inside surface of which the second auxiliary pillar flap is adhesively secured.

Figure 7:
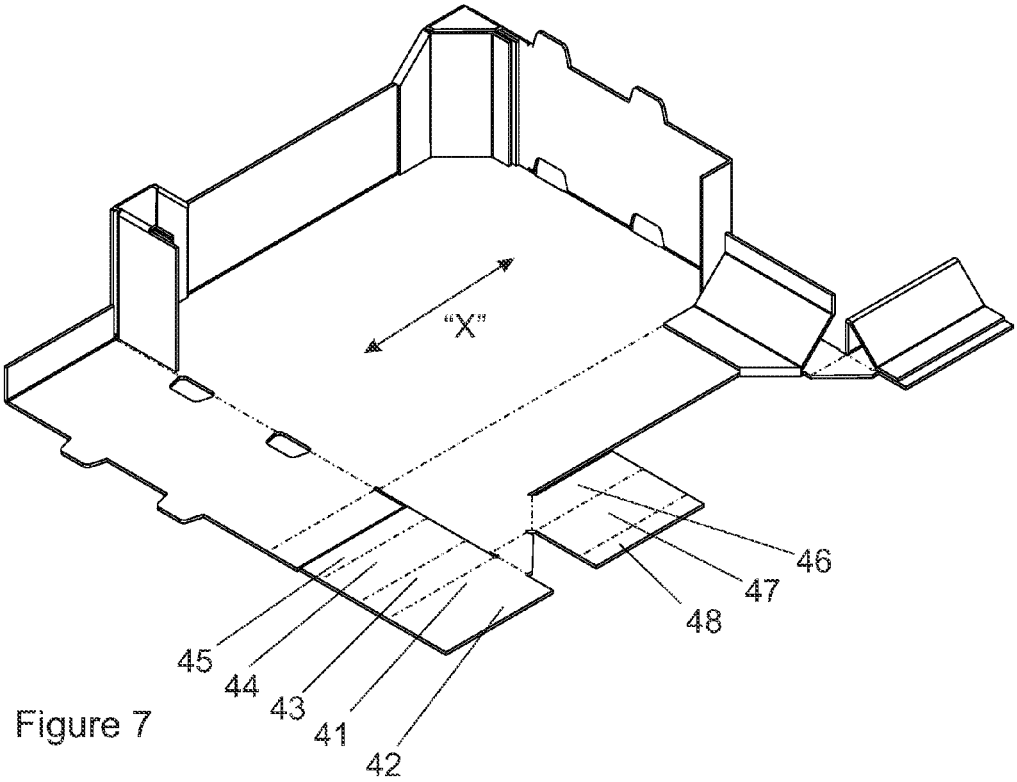
FIG. 7 is similar to FIG. 3 but illustrating a second variation of the embodiment of the invention illustrated in FIGS. 1 to 4.
Figure 8:
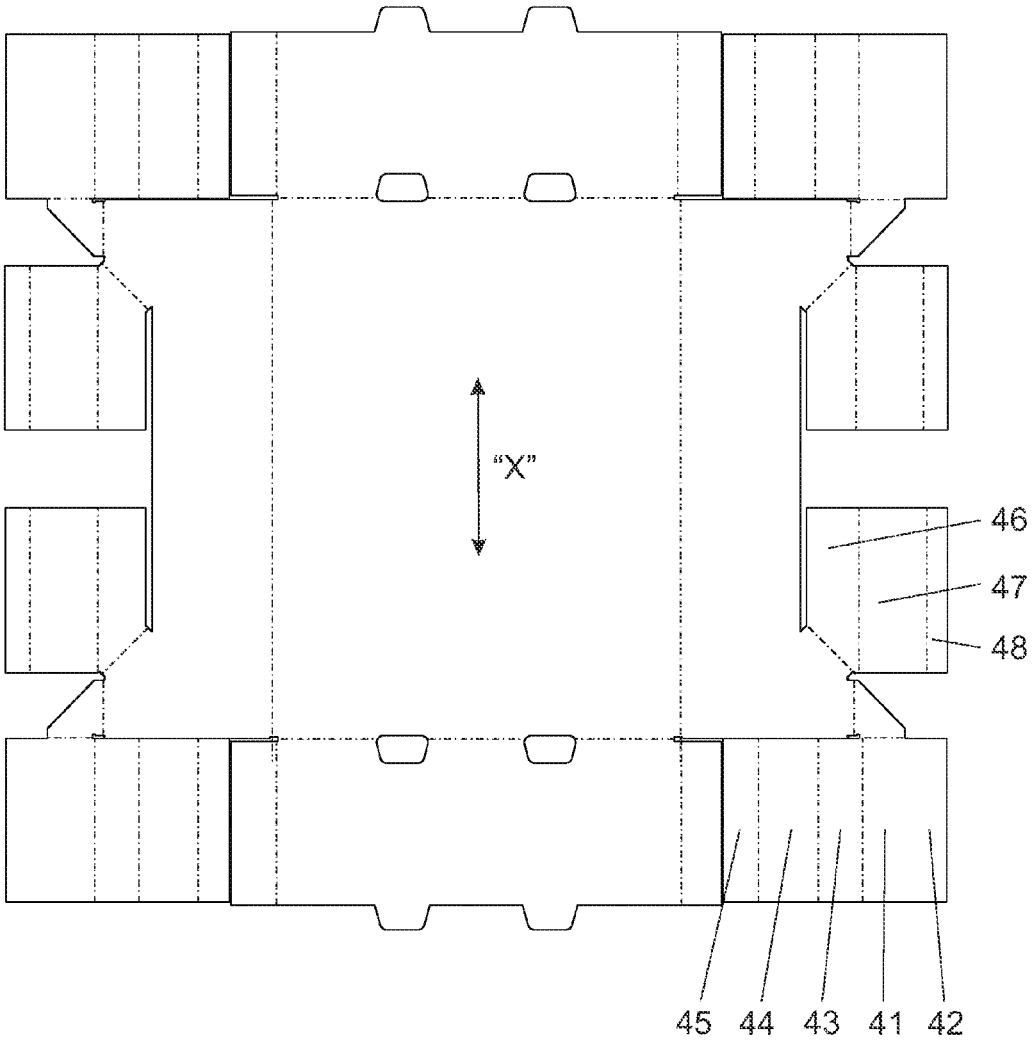
FIG. 8 is a plan view of a blank that has been cut and sulcated to form the embodiment of box illustrated in FIG. 7.
Figure 9:
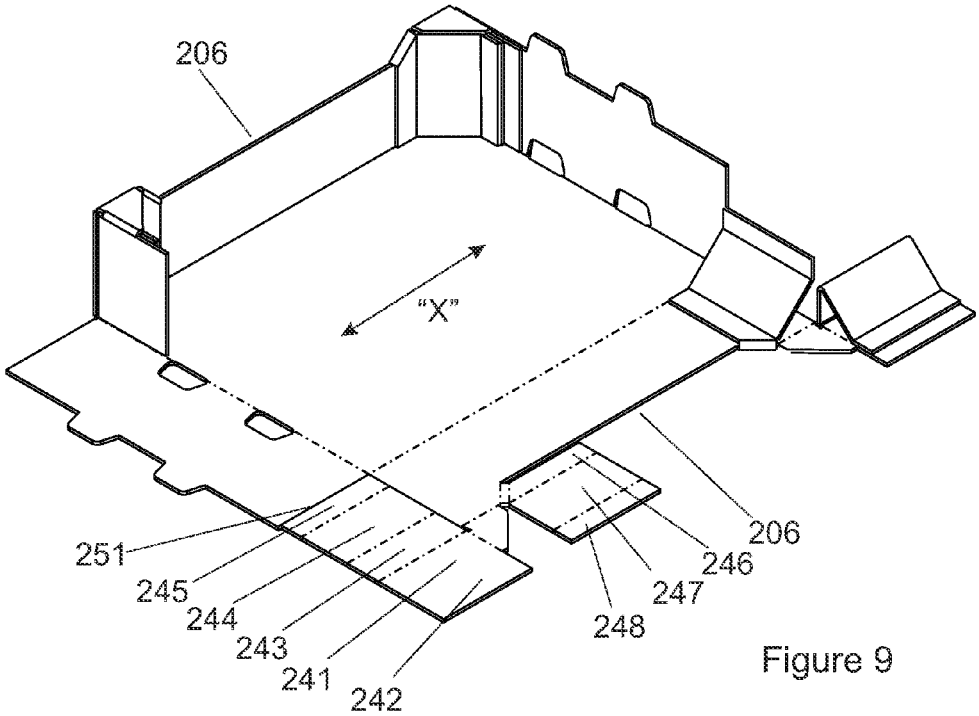
FIG. 9 is an isometric view of a partially folded box illustrating an embodiment of the invention that has no attachment flap on the ends of the end walls.

The embodiment of box that is illustrated in FIG. 9 corresponds substantially to that described with reference to FIGS. 7 and 8 in that it has a first pillar flap (241) with a co-planar extension (242) in the direction away from the second and third pillar flaps (243, 244 respectively). In that instance, there is sufficient material available for a fourth pillar flap (245) and there is no attachment flap so that the juxtaposed first, second, third and fourth pillar flaps together extend all the way to a clean cut end (251) to the adjacent end wall edge in the blank condition.

The overall width of the blank enables composite flaps to be formed adjacent the indent (206) with each composite flap comprising a strip (246) for adhesive securing to the inside of the relevant side wall and first and second auxiliary pillar flaps (247, 248 respectively). In this instance the first auxiliary pillar flap (247) is dimensioned so that it can be secured over the diagonally extending third pillar flap (244) that, in this instance, is held in its erected position by the fourth pillar flap (245) that is adhesively secured to the inside of the extension to the first pillar flap and to the inside surface of which the second auxiliary pillar flap is adhesively secured.

Figure 10:
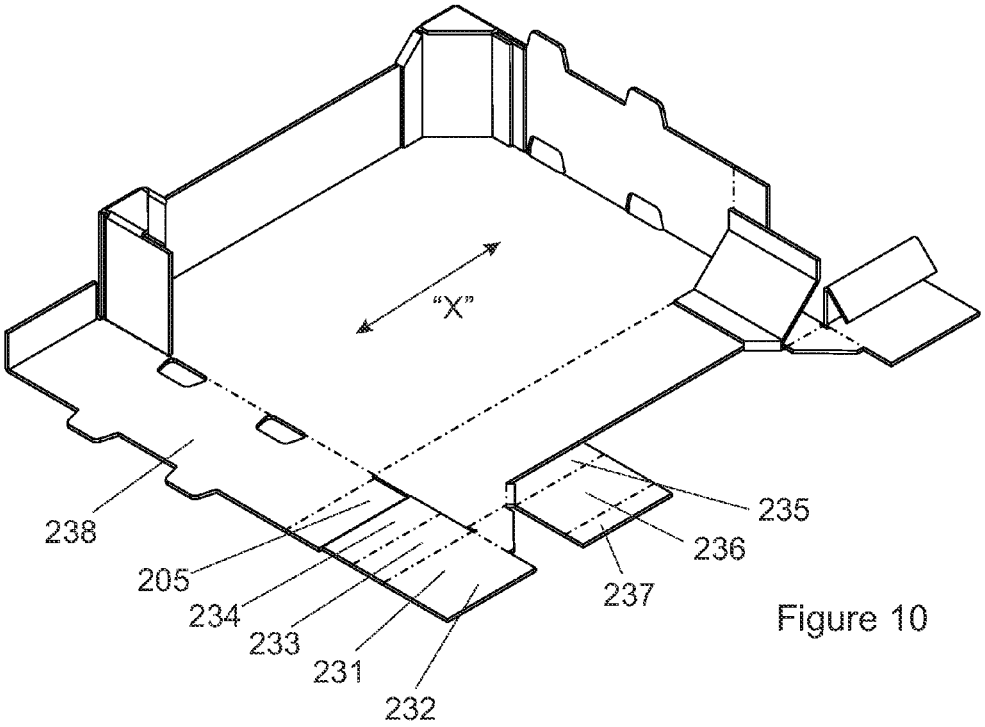
FIG. 10 is an isometric view of a partially folded box illustrating an embodiment of the invention that has an attachment flap on the ends of the end walls but no fourth pillar flap.

In the embodiment of box illustrated in FIG. 10 the box corresponds substantially to that described with reference to FIGS. 5 and 6 in that it has a blank with a width that enables the first pillar flap (231) to have a co-planar extension (232) in the direction away from the second and third pillar flaps (233, 234 respectively). However, there is no fourth pillar flap.

The overall width of the blank enables composite flaps to be formed into a strip (235) for adhesive attachment to the inside of the relevant side wall, and first as well as second auxiliary pillar flaps (236, 237 respectively). In this instance the first auxiliary pillar flap (236) is dimensioned so that it can be secured over the diagonally extending third pillar flap (234) that, because it has no fourth pillar flap, is simply held captive by the first auxiliary pillar flap (236). The latter is kept in position by the second auxiliary pillar flap being adhesively secured to the inside of the extension of the first pillar flap that in turn is secured to the end wall (238). However, in this instance, there is an attachment flap (205) that is secured to the outside surface of the sidewall in each instance.

Figure 11:
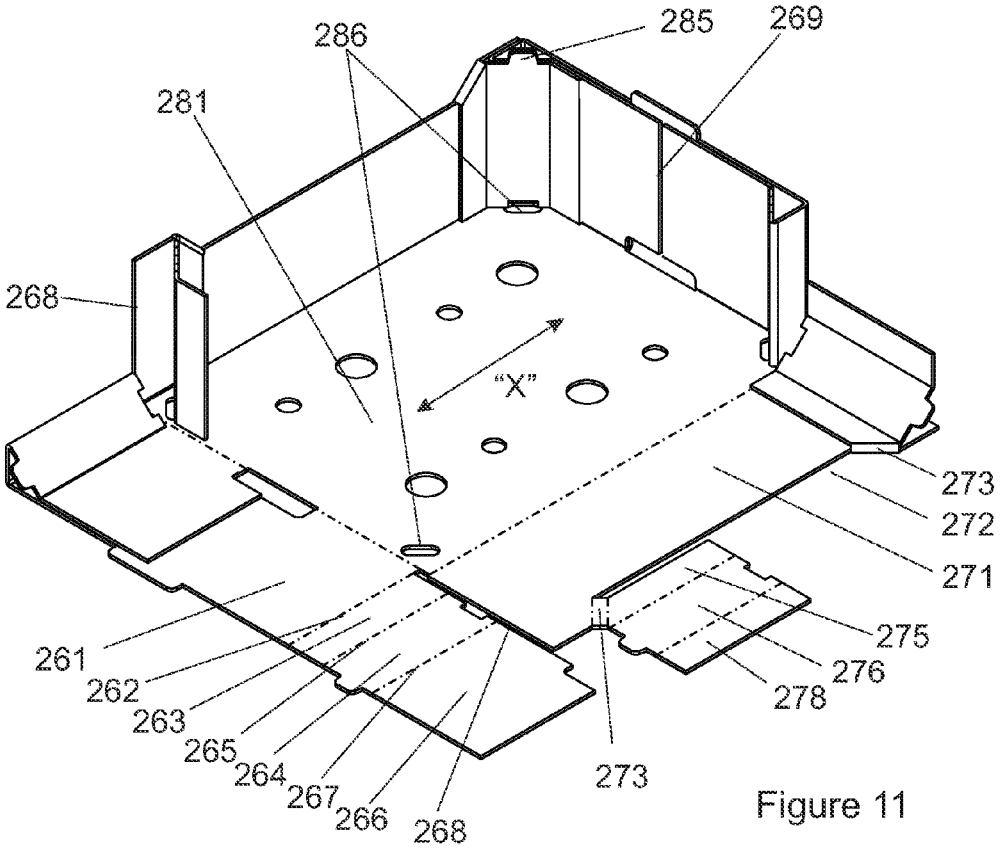
FIG. 11 is an isometric view of a partially folded box illustrating an embodiment of the invention that has no ledge panel at all; and, FIG. 12 is an isometric view of a partially folded box illustrating an embodiment of the invention that has no ledge at all.

FIG. 11 illustrates a variation of the invention in which there is no ledge flap at all, and the end wall (261) of the box is connected directly by way of a sulcation (262) to a primary pillar flap (263); a secondary pillar flap (264) by way of a sulcation (265); and a tertiary pillar flap (266) by way of a sulcation (267) all of which have the flutes extending up the height of the end wall. In this instance there is no available material for the formation of an attachment flap and the ends (268) of the side walls are simply cut at right angles to the length of the sidewall for attachment to the outside of the pillar formation.

The dimensions of the various pillar flaps, and especially the tertiary pillar flap is such that when the tertiary pillar flap is adhesively secured to the inside surface of the end wall (261) the two pillar flaps almost join in the middle, as indicated by numeral (269). The end walls are thus effectively double laminated with a corresponding increase in strength.

The sidewall (271) has an indent (272) extending along a major part of the length of the upper edge thereof with each end of the indent terminating in a diagonal fold (273) inclined upwardly and towards the adjacent end of the box at an angle of 45° that connects the sidewalk to composite flaps of the general nature described above. Each composite flap comprises a strip (275) that is, in the installed condition, approximately beneath the diagonal fold and is adhesively secured to the inside of the side wall of the box.

The composite flap also includes a first auxiliary pillar flap (276) attached to the strip (275) along the edge thereof nearer the adjacent corner of the box with the attachment being by way of a fold extending along a sulcation that is generally vertical. The first auxiliary pillar flap (276) is attached to a second auxiliary pillar flap (278) by way of a sulcation.

In erecting a box as described with reference to FIG. 11, the pillars can be formed at the ends of the end walls with the end wall then being folded inwards prior to the sidewalls being folded upward from the bottom (281) with the ends of the sidewalls being adhered to the sides of the pillars. The composite flap can be folded inwards so that the flutes extend up the height of the sidewall and the first auxiliary pillar flap and second auxiliary pillar flap can then be secured to the inner surfaces of the pillar and inner surface of the third pillar flaps that are already secured to the inside surface of the end wall.

Consequent on the fact that there is no ledge panel in this instance, a different arrangement of upwardly projecting tabs (285) may be provided at the upper edges of the box with corresponding cut-outs (286) in the form of holes being formed in the bottom of the box. The upwardly projecting tabs may be provided at the upper edges of the diagonal of the triangular pillars. Alignment of the upwardly projecting tabs with the holes facilitates vertical alignment of the boxes when stacking one box on top of another.

Figure 12:
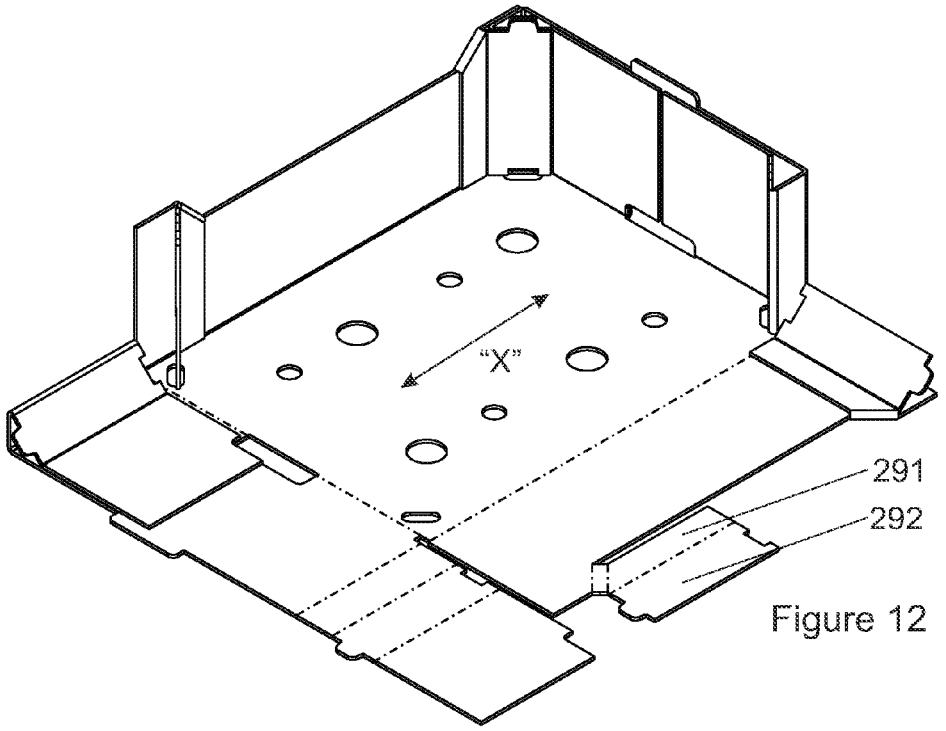

FIG. 12 illustrates a variation of the arrangement illustrated in FIG. 11 in that the composite flap has only the strip (291) and a single first auxiliary pillar flap (292), this arrangement being selected to utilize the overall width of the blank.

Clearly each and every application in practice will have its own requirements and the solution to each practical need can be individually designed.

Numerous variations may be made to the embodiments of the invention described above without departing from the scope thereof.

In particular, it is not necessary to have a triangular cross-sectioned pillar at the corners of the box and, for example, the third pillar flap may be secured back onto the second pillar flap in which instance any fourth pillar flap may be secured to the inside of the first pillar flap that is secured to the end wall. In such an instance, the composite flap is secured to the inside surface of the side wall with its flutes extending vertically, could have the second pillar flap adhesively secured to its outer surface with the entire composite flap being secured to the side wall. The entire arrangement would be dependent on the geometry of the situation and the requirements.

It is also envisaged that a pillar could be constructed in a different way and that it may be possible to avoid the use of the first, second, third ,and, as may be applicable, fourth, pillar flaps that could be replaced by a different construction.

The strength of a box having the construction as described above is highly significant as it enables the strength, and therefore the cost, of the corrugated cardboard sheet material to be reduced significantly. It has been estimated that corrugated cardboard trays commonly used for packing avocado pears can be appreciably reduced in cost by using the construction of the invention. Currently used corrugated cardboard has layers of corrugations of the "B" and "E" flute and it has been estimated that this could be replaced by one having a single layer of corrugations of the "B" flute.

Numerous variations may be made to what is described above without departing from the scope hereof.

The invention claimed is:

1. A stackable open topped box made of a folded blank of fluted sheet material in which two opposite side walls and two opposite end walls are folded at generally right angles along sulcations attaching them to a rectangular bottom of the box wherein flutes of the fluted sheet material extend parallel to the side walls of the box and up the height of the end walls, wherein the side walls each have an indent extending along the upper edge thereof for a substantial part of the length of the side wall with each end of the indent terminating in a diagonal fold inclined upwardly and towards the adjacent end of the box at an angle of 45° with fluted sheet material originally adjacent the edge of the indent being folded inwards and downwards as a composite flap such that flutes of the fluted material extend at right angles to the flutes of the side walls and the material extends to substantially the bottom of the box and whereof a strip that is approximately beneath the diagonal fold is flush with the inside of the side wall of the box.

2. A stackable open topped box as claimed in claim 1 in which the strip of the composite flap is adhesively secured to the inside surface of the side wall of the box.

3. A stackable open topped box as claimed in claim 1 in which the composite flap includes a first and optionally a second auxiliary pillar flap attached to the strip on a side thereof nearer an adjacent corner with the first and any second auxiliary pillar flaps being attached to the strip and to each other by fold lines at sulcations extending up the height of the box.

4. A stackable open topped box as claimed in claim 1 in which the side walls have a small ledge panel attached to an upper edge of the relevant side wall adjacent the upper end of the diagonal fold by way of a fold at a sulcation so as to project over a pillar formation in a corner of the box.

5. A stackable open topped box as claimed in claim 4 in which the pillar formation includes a first pillar flap having an upper end connected to an end of the ledge panel by way of a fold at a sulcation with the first pillar flap extending substantially to the bottom of the box and being secured to the adjacent end wall thereby conforming to a corner of the box, and at least second and third pillar flaps attached to the first pillar flap and each other by folds at sulcations extending up the height of the box with the second pillar flap being secured to the side wall, or an attachment flap that may already be secured to the side wall and being attached to the first pillar flap substantially in the corner of the box, wherein the arrangement is such that the flutes of each of any attachment flap, and the first, second and third pillar flaps, as well as the composite flap, extend in the direction of the height of the box.

6. A stackable open topped box as claimed in claim 5 in which the first pillar flap has a coplanar extension extending away from the corner of the box and being secured to the inside of the end wall.

7. A stackable open topped box as claimed in claim 5 in which a fourth pillar flap is attached to the third pillar flap by a fold at a sulcation with the flutes of the fourth pillar flap extending up the height of the box.

8. A stackable open topped box as claimed in claim 5 in which the third pillar flap extends diagonally across the corner to form a triangular cross-sectioned pillar in which instance any fourth pillar flap may be secured to the inside of the end wall or the inside of the first pillar flap or a coplanar extension thereto.

9. A stackable open topped box as claimed in claim 1 in which an attachment flap is provided at each end of each end wall with the attachment flap at each end of the wall defined by a sulcation of the sheet material extending up the height of the box.

10. A stackable open topped box as claimed in claim 1 in which each end of each end wall is simply cut straight and adhesively secured to a formed pillar formation.

11. A blank of fluted sheet material that has been cut and sulcated to be folded into a box as defined in claim 1, the blank being basically in the form of a rectangular piece of fluted sheet material cut and sulcated to provide two opposite side walls and two opposite end walls attached along sulcations to a rectangular bottom of the box wherein the flutes extend along the length of the side walls and in a direction corresponding to the height of the end walls; and wherein the side walls have an indent extending along the edge thereof remote from the bottom for a substantial part of the length of the side wall with each end of each indent terminating in a diagonal sulcation inclined outwards in a direction corresponding to the adjacent end of the box at an angle of 45° with fluted sheet material adjacent the edge of the indent forming a composite flap capable of being folded along the diagonal sulcation over the sidewall such that the flutes of the composite flap extend at right angles to those of the side wall, wherein the composite flaps are dimensioned such that, in such folded over position, the composite flaps extend to substantially the bottom of the box.

12. A blank of fluted sheet material as claimed in claim 11 in which the side walls have a small ledge panel attached to the outermost edge towards each end of the relevant side wall by way of a sulcation, and wherein the ledge panel is attached by way of a sulcation to one end of a first pillar flap extending in the direction of the flutes and that is, in turn, attached to at least a second and a third pillar flap each of which is attached to the other by a sulcation extending in a direction corresponding to the height of the box and the direction of the flutes.

13. A blank of fluted sheet material as claimed in claim 12 in which the first pillar flap has a coplanar extension on the side thereof opposite the second pillar flap.

14. A blank of fluted sheet material as claimed in claim 11 in which the blank is especially designed so as to be capable of machine erection utilising adhesive to secure appropriate areas of the fluted sheet material together.

* * * * *